US006295685B1

(12) United States Patent
Douglas

(10) Patent No.: US 6,295,685 B1
(45) Date of Patent: Oct. 2, 2001

(54) INTERNAL FERRULE FOR PAINT BRUSH WITH BRISTLE CLAMPING PANEL AND REMOVABLE BRISTLE PACK

(75) Inventor: Terry R. Douglas, Surrey (CA)

(73) Assignee: Kwick Clean and Green Ltd., Surrey (CA)

( * ) Notice: Subject to any disclaimer, the term of this patent is extended or adjusted under 35 U.S.C. 154(b) by 0 days.

(21) Appl. No.: 09/482,864

(22) Filed: Jan. 14, 2000

(30) Foreign Application Priority Data

Aug. 13, 1999 (CA) ..... 2280332

(51) Int. Cl.[7] ..... A46B 3/08; A46B 3/12

(52) U.S. Cl. ..... 15/146; 15/176.6; 15/178; 15/194; 15/DIG. 4

(58) Field of Search ..... 15/146, 147.1, 15/150, 159.1, 168, 169, 171, 176.1, 176.6, 177, 178, 191.1, 194, DIG. 4

(56) References Cited

U.S. PATENT DOCUMENTS

| | | | |
|---|---|---|---|
| 134,745 | | 1/1873 | Gorman . |
| 235,841 | | 12/1880 | Wright . |
| 568,267 | | 9/1896 | McIver et al. . |
| 911,466 | | 2/1909 | Wilkins . |
| 1,358,369 | | 11/1920 | Forester . |
| 2,860,361 | | 11/1958 | Moody . |
| 2,900,654 | * | 8/1959 | Koltvedt . |
| 2,912,709 | | 11/1959 | Carlson et al. . |
| 3,340,557 | | 9/1967 | Rosenzweig . |
| 3,416,179 | * | 12/1968 | Wiese . |
| 3,783,468 | | 1/1974 | Saloutos . |
| 4,129,918 | | 12/1978 | Lee . |
| 4,237,579 | | 12/1980 | Salmon . |
| 4,790,679 | | 12/1988 | Murphy . |
| 5,218,733 | | 6/1993 | Leu . |
| 5,289,606 | | 3/1994 | Ledingham . |
| 5,315,733 | | 5/1994 | Ledingham . |
| 5,359,749 | * | 11/1994 | Chu . |
| 5,435,037 | | 7/1995 | Ledingham . |
| 6,035,481 | * | 3/2000 | Douglas et al. . |

FOREIGN PATENT DOCUMENTS

| | | |
|---|---|---|
| 22754 | 1/1906 | (AT) . |
| 86543 | 9/1920 | (CH) . |
| 86377 | 7/1895 | (DE) . |
| 916406 | 7/1954 | (DE) . |
| 3105169 | 9/1982 | (DE) . |
| 3237506 | 4/1984 | (DE) . |
| 714282 | 11/1931 | (FR) . |
| 1013013 | 7/1952 | (FR) . |
| 606536 | 8/1948 | (GB) . |
| 1260859 | 1/1972 | (GB) . |
| 2096888 | 10/1982 | (GB) . |
| WO 92/13472 | 8/1992 | (WO) . |
| WO 96/17536 | 6/1996 | (WO) . |

* cited by examiner

*Primary Examiner*—Terrence R. Till
(74) *Attorney, Agent, or Firm*—Oyen Wiggs Green & Mutala

(57) ABSTRACT

This invention pertains to a novel internal ferrule which is used in a paint brush that has a removable bristle pack and one or more moveable bristle clamping panels which, when in a closed position, grip the bristle pack and prevent paint from migrating up the bristles to the base of the paint brush handle. The paint brush with the internal ferrule and the removable bristle pack is easy to use, and provides ready cleaning after use, by releasing the one or more panels and enabling the bristle pack to be removed and exposed to the cleaning solution. An internal ferrule for use with a paint brush handle and a removable bristle pack comprising: (a) a hollow girdle for encircling a first end of a bundle of parallel bristles, the girdle having interior and exterior faces; (b) a concave glue cavity formed in an interior face of the hollow girdle; and (c) a protrusion formed on an exterior face of the girdle for engaging with a corresponding cavity formed in the body of a paint brush handle.

14 Claims, 7 Drawing Sheets

INTERNAL FERRULE FOR PAINT BRUSH WITH BRISTLE CLAMPING PANEL AND REMOVABLE BRISTLE PACK

FIELD OF THE INVENTION

This invention pertains to a novel internal ferrule which is used in a paint brush that has a removable bristle pack and one or more moveable bristle clamping panels which, when in a closed position, grip the bristle pack and prevent paint from migrating up the bristles to the base of the paint brush handle. The paint brush with the internal ferrule and the removable bristle pack is easy to use, and provides ready cleaning after use, by releasing the one or more panels and enabling the bristle pack to be removed and exposed to the cleaning solution.

BACKGROUND OF THE INVENTION

A longstanding problem with paint brushes that have fixed bristles that are used for industrial and domestic painting applications is that with time and repeated use, paint tends to build up within the bristles of the brush in the region where the bristles are held by the ferrule clamp that joins the bristles with the paint brush handle and base. The collected paint in this confined area is difficult to clean away. Usually, some residual paint is left in the bristles at the junction with the ferrule even after the used brush has been cleaned. The dried paint at this location collects and builds up over time with repeated use of the paint brush. This causes the bristles of the brush to spread and thereby reduces the efficiency of the brush. Also, the build up of dried paint tends to cause the bristles to wear and break at the location of the dried paint. This reduces the life of the paint brush.

Proper cleaning of a paint brush requires a considerable amount of solvent, if the person cleaning the brush is meticulous. If the paint has a water base, this is also a serious problem because large amounts of water are wasted attempting to thoroughly clean the brush. However, if the paint is an oil base paint, then expensive petroleum paint solvent or thinner is required for cleaning. The use of a petroleum base solvent constitutes a waste of costly solvent and at the same time creates an environmental pollutant. Most commercial painters will tend to minimize costs by balancing the amount of the solvent used with the number of times the paint brush is used. It may be economic, for instance, to only expect a paint brush to be used a half-dozen times before it must be discarded, rather than incur the cost and waste a considerable amount of solvent attempting to meticulously clean the brush after each use, and prolong the life of the paint brush.

A paint brush which minimizes or eliminates the build up of paint in the location where the bristles are set or meet the paint brush handle is desirable. Any invention which reduces the amount of solvent which is required to clean a paint brush is useful. It is also beneficial if a mechanism is used which reduces or eliminates bristle flare as it occurs over time when a paint brush is repeatedly used.

U.S. Pat. No. 5,289,606, Mar. 1, 1994, Blake A. Ledingham, discloses a unitary paint brush which comprises a paint brush body attached to a handle. The body defines a cavity adapted for receiving a group of bristles. A pair of hinged releasable flaps project over the cavity to abut the bristles when moved to a closed position. The bristles are released by moving the flaps into an open position. The hinged flaps are held in place on the bristle pack base by springs which can be rotated from a flap open position to a flap closed position, and vice versa. A problem with the springs is that they are a separate component from the body and raise manufacturing expense.

U.S. Pat. No. 5,315,733, May 31, 1994, Blake A. Ledingham, discloses a paint brush bristle clamp which can be removed after paint brush use, and facilitates cleaning of paint from the brush. The removable paint brush bristle clamp comprises: a pair of opposed end walls; a first side wall located between the pair of end walls and joined thereto; a second side wall opposed to the first side wall, the second side wall being joined at one end to one of the end walls, the opposite end of the second side wall being free and having a first lip formed thereon; and a second lip formed on one end of one of the end walls, adjacent to the lip formed on one edge of the adjacent side wall, said second lip being adapted to mate with the first lip on the side wall to thereby provide an opening and closing action.

U.S. Pat. No. 5,435,037, Jul. 25, 1995, Blake A. Ledingham, discloses a paint brush with a replaceable bristle pack. The unitary paint brush with replaceable bristles comprises: a paint brush body and handle, the body having formed in one end thereof opposite the handle a cavity adapted for receiving a group of bristles; at least one releasable member secured to one side of the paint brush body, and projecting over the cavity, the releasable member being capable of butting the bristles when moved to a first closed position, and being removed from the bristles when moved to a second open position; at least one movable securing member for securing the hinged releasable member in a first position and releasing the hinged releasable member for movement to a second open position; and a group of bristles held together and located within the cavity of the holder, and held in place by the hinged releasable member, said bristle group being removable and secured in place by the releasable member.

U.S. Pat. No. 4,129,918, Dec. 19, 1978, Robert Lee, discloses an adjustable sleeve for an artist's paint brush adapted to adjust the effective length of the bristles of the brush. The adjustable sleeve is tubular at its tip to contain the hair or bristles. The sleeve is split above the tip to provide a spring biased grip upon the brush ferrule. The adjustable sleeve is tapered in substantial conformity with the taper of the ferrule and it is longitudinally adjustable relative to the ferrule to vary the effective length of the hair or bristles. The sleeve is designed for use with an artist's brush, which has bristles arranged in a taper column form. The sleeve does not fit over the base of the brush at the location where the bristles meet the base.

U.S. Pat. No. 4,237,579, Dec. 9, 1980, Jonathan H. Salmon, discloses a tool for applying a liquid stain to a flat surface to impart a timber grain effect to the surface. The tool comprises a paint brush, a bristle retaining slidable plate on one side of the brush and a slidable comb plate on the other side of the brush. Both of the plates have an elongated slot which engages a bolt which passes through the paint brush. The comb adjustably separates the brush bristles into discrete bunches to permit the application of stain to impart a wood grain pattern to the surface. This tool does not disclose a holder which fits on both sides of the paint brush base where the bristles are secured to the base. The tool is not designed to prevent paint from migrating down the bristles in the direction of the base.

U.S. Pat. No. 4,339,837, Jul. 20, 1982, Christiaan Reeberg, discloses a sliding box-like girdle which fits over a paint brush to confine the bristles. The girdle acts as a hanger so that the paint brush can be hung on a wall. The girdle also protects the brush bristles while on display, or during storage. Further, the girdle is used to control the effective length of the bristle ends for specific painting jobs. The girdle also serves to squeeze excess paint from the bristles after each dip into a can of paint. The girdle does not serve to encircle the base of the paint brush, where the bristles meet the paint base, and thereby prevent paint from migrating along the bristles to the base, and thereby collecting at the base-bristle ended face.

French Patent. No. 714,282, Deroubaix et al., published Nov. 10, 1931, discloses a paint brush with a removable bristle pack, a hinged panel 5 which, in a closed position, grips the bristles 7, and a ring 8 which encloses the bristles 7. The ring 8 can possibly be interpreted as an internal ferrule. However, the ring 8 has no ridges that fit within grooves inside the cavity. Also, Deroubaix et al. use a sliding ring 9 which can be moved up once the panel 5 is closed in order to hold the brush together (see FIG. 4).

SUMMARY OF THE INVENTION

The invention is directed to an internal ferrule for use with a paint brush handle and a removable bristle pack comprising:

(a) a hollow girdle for encircling a first end of a bundle of parallel bristles, the girdle having interior and exterior faces;

(b) a concave glue cavity formed in an interior face of the hollow girdle; and (c) a protrusion formed on an exterior face of the girdle for engaging with a releasable securing member associated with the body of a paint brush handle.

The ferrule can have a hollow rectangular or oval shape. The rectangular shaped ferrule can have a pair of protrusions formed in opposite exterior face ends of the ferrule. A complementary pair of protrusions can be formed on opposite exterior side faces of the rectangular ferrule. Two opposing exterior faces of the internal ferrule can have complementary quadrangle shapes.

The paint brush according to the invention can comprise:

(a) a paint brush body having a first end and a second end, and a first side and a second side, and a handle connected to the first end of the body, the body having formed in the second end thereof opposite the handle a cavity for receiving one end of a group of bristles;

(b) a group of bristles held together and having a first end which is received in the cavity, and a second free end which protrudes from the cavity;

(c) a hollow girdle for encircling the first end of the group of bristles;

(d) a concave glue cavity formed in an interior face of the hollow girdle;

(e) a protrusion formed on the exterior of the hollow girdle for removably engaging with a releasable member associated with the paint brush body; and (f) at least one hinged releasable member secured to the first side of the paint brush body, and projecting over the cavity, the hinged releasable member abutting and securing the girdle when moved to a first closed position, and being spaced from and releasing the girdle when moved to a second open position.

The paint brush can include a securing member for securing the hinged releasable member in the first closed position and releasing the hinged releasable member when in a second open position. The girdle can be an internal ferrule that has a hollow rectangular shape. The hollow rectangular shaped ferrule can have a pair of protrusions formed in opposite exterior face ends of the ferrule. A complementary pair of protrusions can be formed on opposite exterior side faces of the rectangular ferrule. Two opposing exterior side faces of the internal ferrule can have complementary quadrangle shapes.

The hinged releasable member can pivot in a manner whereby the free end of the hinged releasable member, when in a closed position, can abut and hold the external face of the girdle on the bristle pack. The hinged releasable member can pivot in a manner whereby the free end of the releasable member faces the handle of the paint brush and the pivot axis for the releasable member is located laterally across the body of the paint brush at the edge of the cavity. The cavity can include two grooves for receiving the pair of protrusions formed on the exterior faces of the internal ferrule.

DRAWINGS

In the drawings which represent detailed illustrations of specific embodiments of the invention, but which should not be construed as limiting the scope of the invention in any way:

DETAILED DESCRIPTION OF SPECIFIC EMBODIMENTS OF THE INVENTION

The technology relating to paint brushes with replaceable bristle packs as disclosed in U.S. Pats. Nos. 5,289,606 and 5,435,037 is incorporated herein by reference. A problem with the paint brush designs and the replaceable bristle packs as disclosed in the foregoing U.S. patents is that in some instances, the replaceable bristle pack is not held firmly in place in the interior cavity of the paint brush handle and body, when the clamping panel(s) is (are) moved to the normal closed clamping position. Sometimes, even when clamped, due to bristle swell or improper position of the removable bristle pack in the cavity, the removable bristle pack wiggles slightly when pressure is applied to the bristles. This is unacceptable, especially for professional painters who require a firm brush. There is therefore a need for a mechanism which holds the removable bristle pack securely when it is in position in the bristle receiving cavity in the interior of the paint brush handle and body.

Figure 1:
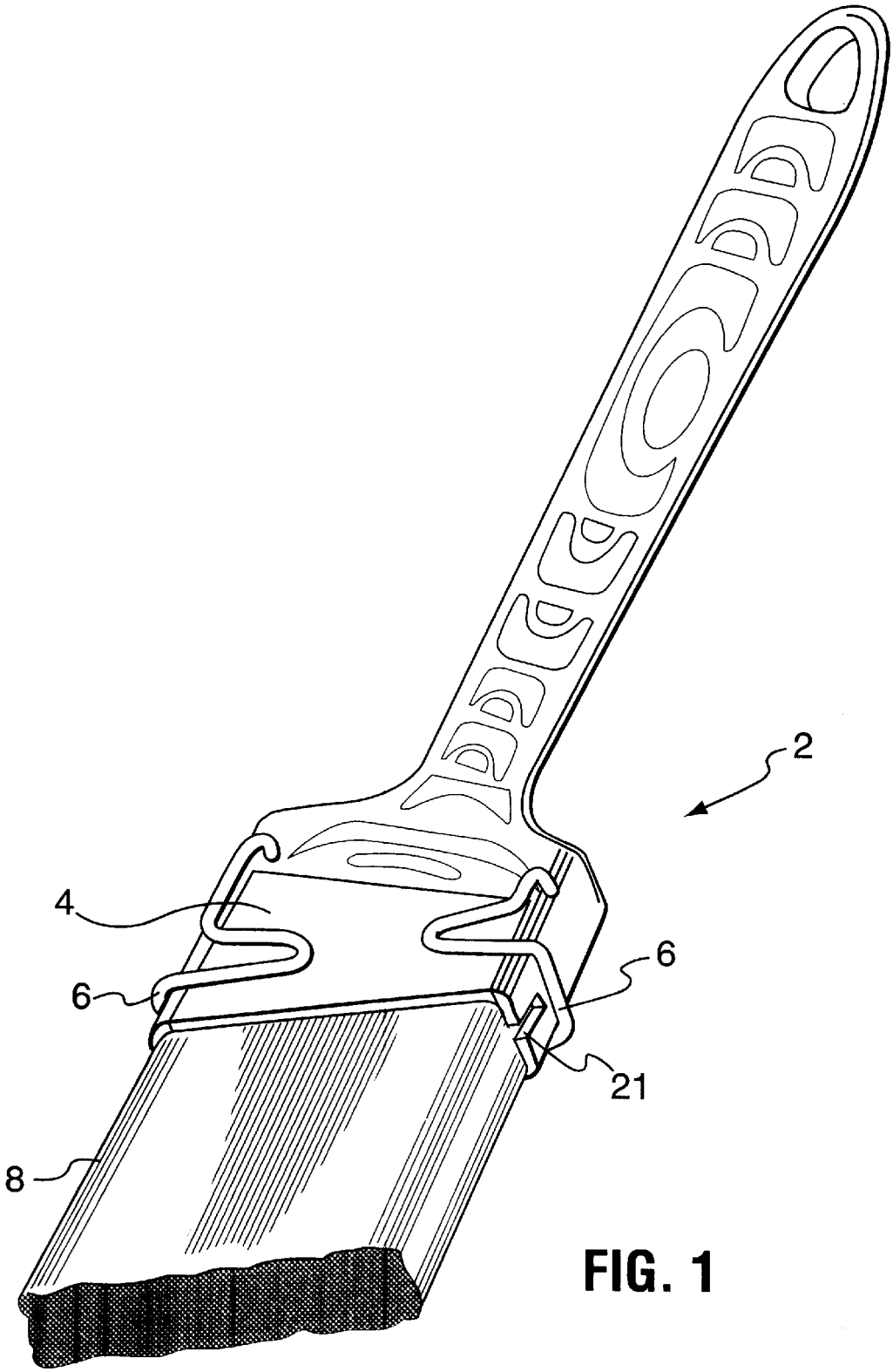
FIG. 1 illustrates a perspective view of a paint brush with a replaceable bristle pack, and panel and clips holding the bristle pack in place.

Referring to the drawings, FIG. 1 illustrates a perspective view of an angle edge paint brush with a replaceable bristle pack and panel, and clips holding the bristle pack in place. As seen in FIG. 1, the paint brush handle 2 has a top hinged clamping panel 4 on the front face of the body of the handle, a pair of closed pivotal clips 6 holding the clamping panel 4 in position against the top end of the removable bristle pack 8, the opposite free bristle end projecting from the interior of the paint brush handle 2. A pair of slits 21 (only one is visible) are formed in the ends of the sides of the handle 2, adjacent the bristle end. The slits 21 provide some "give" in the side ends of the handle 2. As an alternative embodiment, the paint brush can have a second rear top hinged clamping panel, which is held by the same pivotal clips 6.

Figure 2:
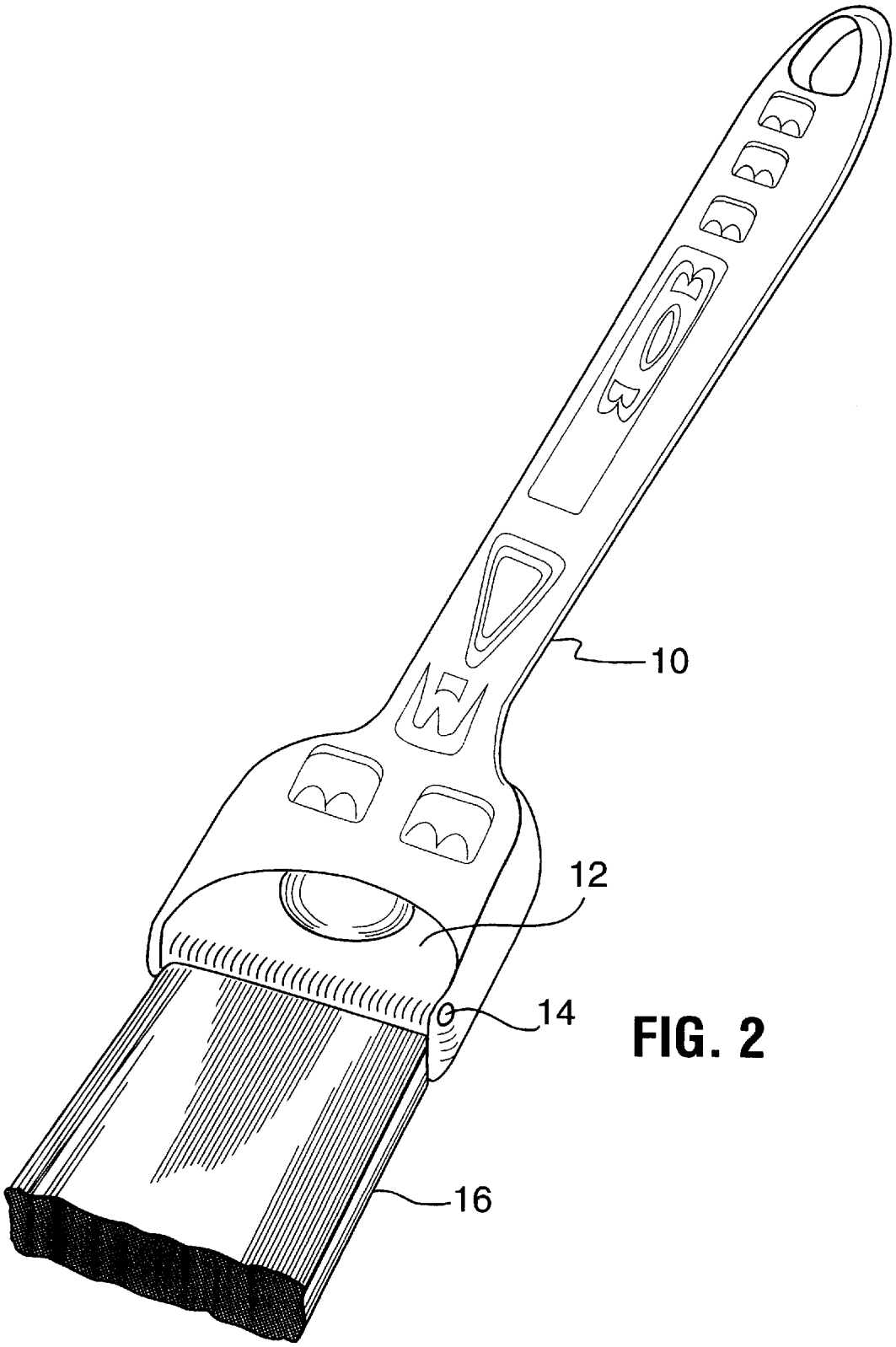
FIG. 2 illustrates a perspective view of a second embodiment of paint brush with replaceable bristle pack, and an inverted single clamping panel.

FIG. 2 illustrates a perspective view of a second embodiment of paint brush with right angle edge, replaceable bristle pack, and a single inverted clamping panel. As seen in FIG. 2, the single inverted clamping panel 12 is formed in the body of the paint brush handle 10 and pivots on pivot pin 14. When the inverted clamping panel 12 is clamped in position against the body of the paint brush handle 10 and the bristle pack 16 (as seen in FIG. 2), the end of the bristle pack 16 with the internal ferrule (not visible) opposite the visible free end is held securely in place in the interior bristle receiving cavity of the body of the paint brush handle 10. The clamping panel 12 has a resilient releasable clip projection 15, which catches under the top edge 17 of the. paint brush body and holds the panel 12 closed (see FIG. 11). While not shown in FIGS. 1 and 2, small slits can be cut in the ends of the sides of the paint brush body, adjacent the cavity and the bristle pack 8 or 16. These slits provide a slight amount of "give" when the bristle pack 8 or 16 is inserted in the cavity (see FIG. 11).

Figure 3:
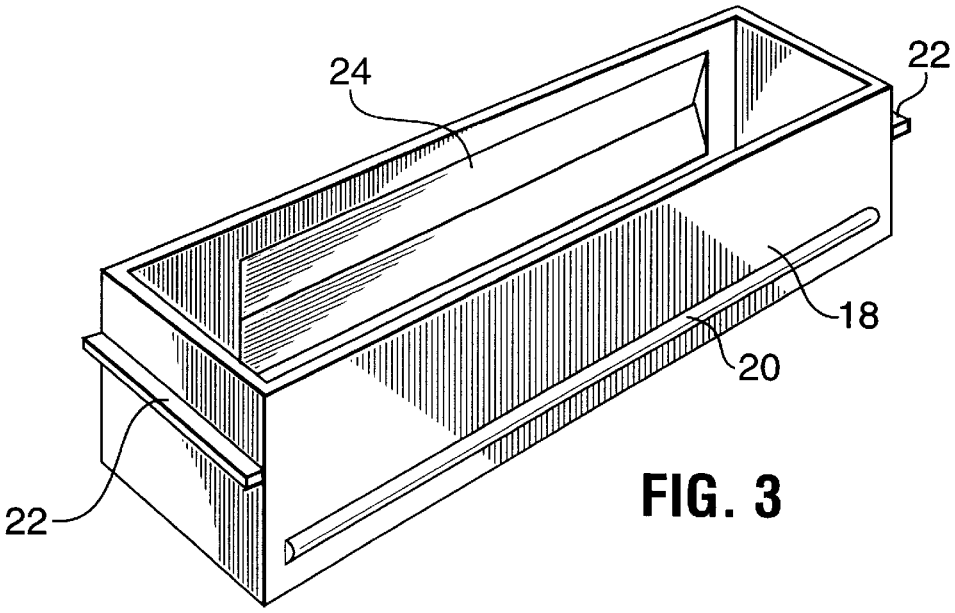
FIG. 3 illustrates a perspective view of an internal ferrule for a paint brush with removable bristle pack, the ferrule having horizontal ridges on both the front and rear faces (not visible) and opposing end ridges.

FIG. 3 illustrates a perspective view of a square edge internal ferrule for the removable bristle pack held in the paint brush. As seen in FIG. 3, the internal ferrule 18 is constructed to have an elongated hollow rectangular shape. On the front elongated face of the internal ferrule 18, there is a long horizontal clamping ridge 20 formed in the lower area of the front panel of the internal ferrule 18. A similar elongated ridge is formed in the rear face of the internal ferrule 18, although it is not visible in FIG. 3. The internal ferrule 18 also has on each end thereof a pair of opposite protruding horizontal end ridges 22. The interior facing front and rear faces of the hollow internal ferrule 18 have formed therein respective glue cavities 24.

Figure 12:
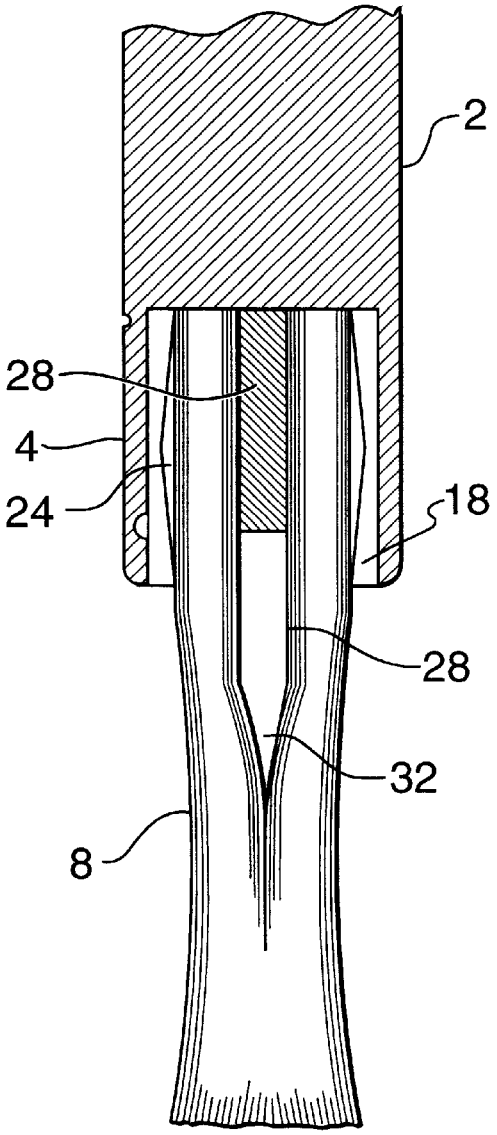
FIG. 12 illustrates an end section view of an embodiment of paint brush that has a single clamping panel and removable bristle pack and an internal ferrule as illustrated in FIGS. 8 and 9 in position in the interior of the body of a paint brush handle.
Figure 13:
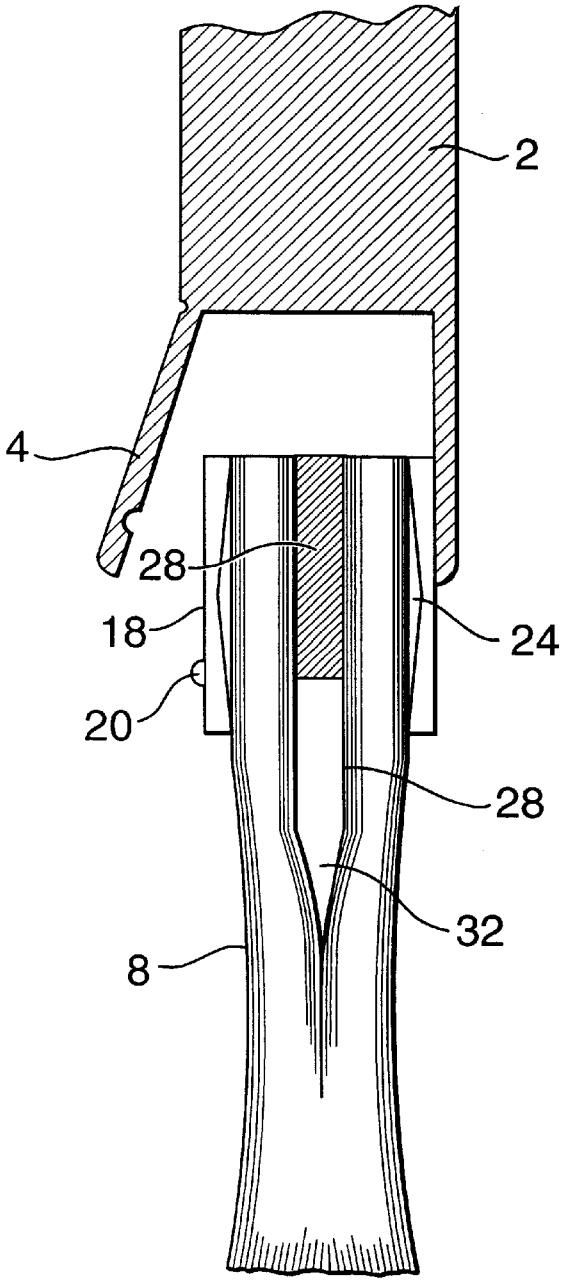
FIG. 13 illustrates an end section view of the paint brush with a single clamping panel and removable bristle pack, with internal ferrule as illustrated in FIGS. 8 and 9, being removed from the interior of the paint brush body handle, after the single clamping panel has been pivoted away from a clamping position.

The internal ferrule 18 as seen in FIG. 3 fits about one end of a removable pack of bristles as seen in FIGS. 12 and 13. The internal ferrule 18 is held securely in place on the end of the bristle pack 8 by glue which is injected into the pair of glue cavities 24 once the internal ferrule 18 has been put in position about one end of the parallel set of bristles forming the bristle pack 8.

Figure 4:
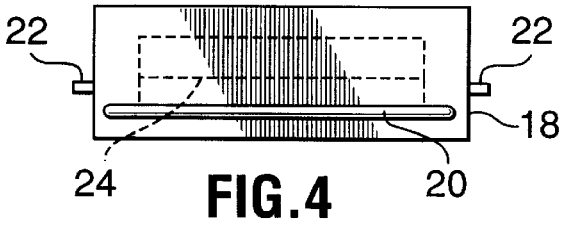
FIG. 4 illustrates a front view of a rectangular shaped internal ferrule, to be used in association with a right angle edge paint brush having either a pair of clamping panels, or a single clamping panel as illustrated in FIGS. 12 and 13.
Figure 5:
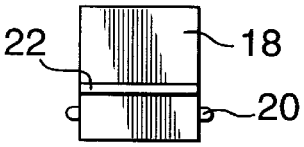
FIG. 5 illustrates an end view of the internal ferrule illustrated in FIG. 4.

FIG. 4 illustrates a front view of the square edge rectangular shaped embodiment of the internal ferrule 18 as seen in FIG. 3. This embodiment of internal ferrule is designed to be used in association with the square edge paint brush illustrated in FIG. 2, similar to the one illustrated in FIG. 1, but with a square edge instead of an angled edge. This embodiment with clips 6 can comprise either one clamping panel 4, or a pair of opposing clamping panels. FIG. 5 illustrates an end view of the internal ferrule illustrated in FIG. 4.

Figure 6:
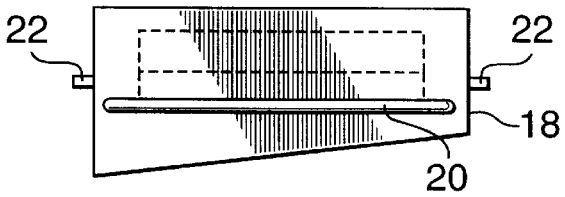
FIG. 6 illustrates a quadrangle shaped internal ferrule for use in association with the angled edge paint brush and replaceable bristle pack illustrated in FIG. 1.
Figure 7:
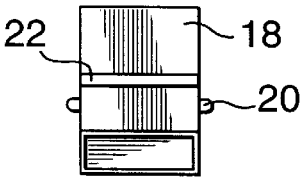
FIG. 7 illustrates an end view of the quadrangle shaped internal ferrule illustrated in FIG. 6.

FIG. 6 illustrates a quadrangle shaped internal ferrule for use in association with the angle edge paint brush and replaceable bristle pack illustrated in FIG. 1. As seen in FIG. 6, the internal ferrule 18 has elongated horizontal front and rear face ridges 20 and opposite protruding end ridges 22. FIG. 7 illustrates an end view of the quadrangle shaped internal ferrule illustrated in FIG. 6. The clamping panel 4 of the paint brush illustrated in FIG. 1 has a quadrangular shape to conform with the angled end of the bristles 8.

Figure 8:
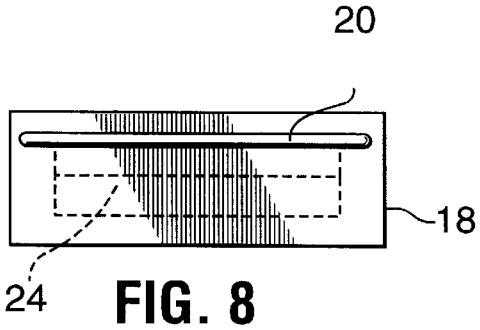
FIG. 8 illustrates a front view of an embodiment of internal ferrule that has protruding front and rear ridges but not end ridges.
Figure 9:
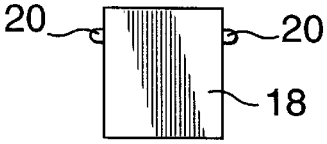
FIG. 9 illustrates an end view of the embodiment of internal ferrule illustrated in FIG. 8.

FIG. 8 illustrates a front view of an embodiment of internal ferrule that has protruding front and rear ridges but not end ridges. FIG. 9 illustrates an end view of the embodiment of internal ferrule illustrated in FIG. 8.

Figure 10:
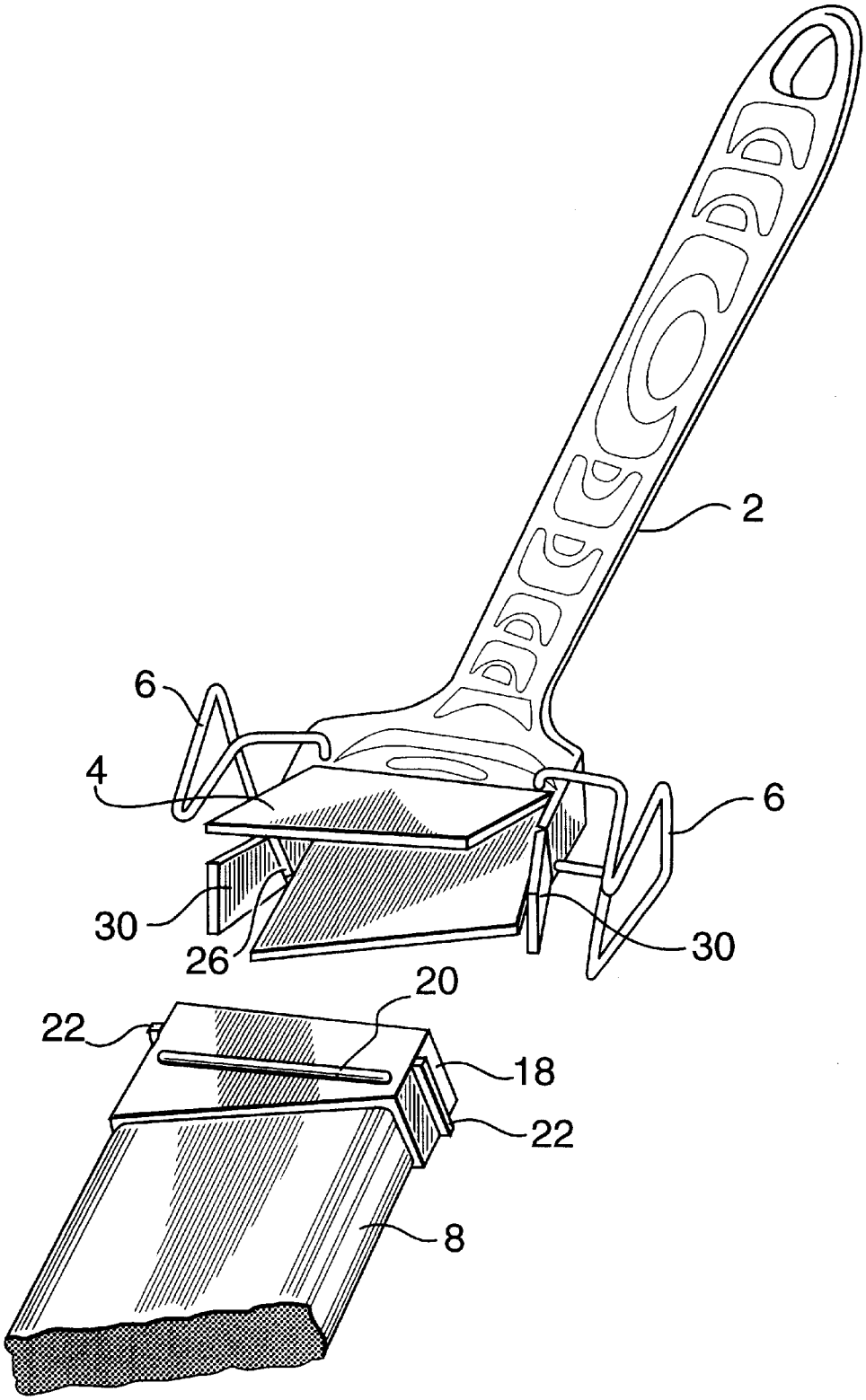
FIG. 10 illustrates an exploded perspective view of the angle edge paint brush and replaceable bristle pack as illustrated in FIG. 1, with the clips moved away from the pivotable clamping panel, the clamping panel in raised position, and the bristle pack and internal quadrangular shaped ferrule as illustrated in FIGS. 6 and 7 removed from the interior of the body of the paint brush handle.

FIG. 10 illustrates an exploded perspective view of the angle edge paint brush and replaceable bristle pack as illustrated in FIG. 1, with the pair of clips 6 moved away from the pivotable clamping panel 4, the clamping panel in raised position, and the removable bristle pack and internal quadrangle shaped ferrule removed from the interior bristle receiving cavity of the body of the paint brush handle 2. As seen in FIG. 10, the pair of clips 6 have been moved away from the clamping panel 4 and the body of the paint brush. The clamping panel 4 has been moved to a raised position, and the bristle pack 8, with the internal ferrule 18 glued in position on one end of the parallel pack of bristles 8 has been withdrawn from the interior of the paint brush handle 2. FIG. 10 also illustrates how the two pivotal end panels 30 can be pivoted outwardly to enable the bristle pack 8 and internal ferrule 18 to be readily inserted and removed from the interior cavity in the paint brush handle 2.

FIG. 10 also illustrates one of a pair of internal grooves 26 which are formed in the interior of the cavity in the paint brush handle 2 at the top end of each of the two pivotal end panels 30. The pair of internal grooves 26 are designed to conform with and receive the pair of opposite protruding end ridges 22, which extend from each end of the internal ferrule 18. The pair of elongated ridges 20 on the front and rear faces of the internal ferrule 18 are used to provide a friction bearing face which can be gripped securely by the interior face of the clamping panel 4 when it is moved to a lower clamping position and clipped by clips 6, as illustrated in FIG. 1.

Figure 11:
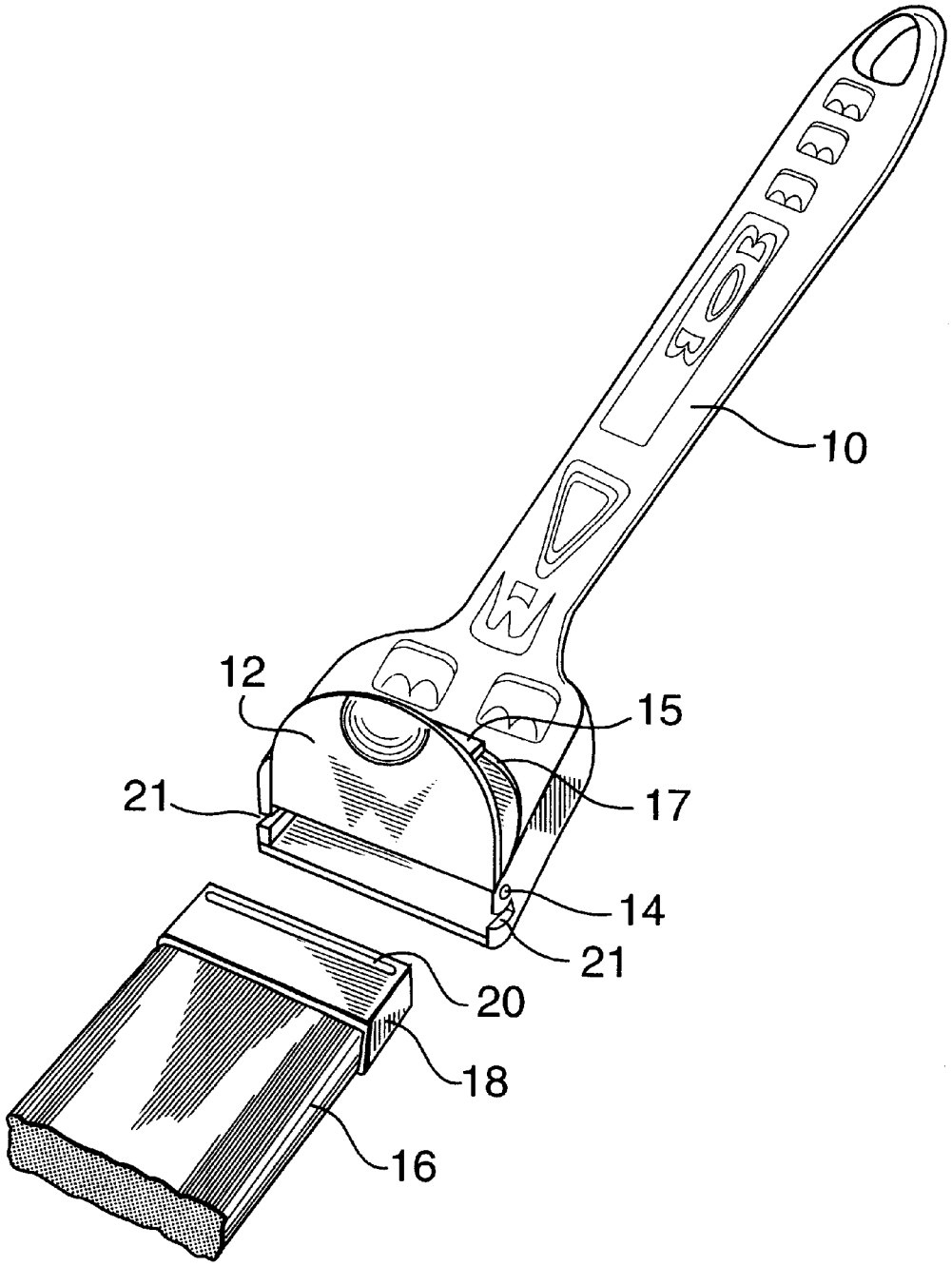
FIG. 11 illustrates an exploded perspective view of a paint brush and replaceable bristle pack as illustrated in FIG. 2, with the inverted pivotable clamping panel in raised position and the bristle pack with the embodiment of internal ferrule that is free of end ridges as illustrated in FIGS. 8 and 9 removed from the interior of the body of the paint brush handle.

FIG. 11 illustrates an exploded perspective view of a paint brush and replaceable bristle pack as illustrated in FIG. 2, with the inverted pivotable clamping panel 12 in raised position and the replaceable bristle pack 16 with the internal ferrule 18 removed from the interior cavity of the body of the paint brush handle 10. As seen in FIG. 11, the clamping panel 12 of the paint brush 10 has been pivoted to a raised position. This permits the bristle pack 16 and the internal ferrule 18 to be removed from the interior of the cavity formed in the body of the paint brush handle 10. Unlike the design of internal ferrule illustrated in FIG. 10, in this embodiment of paint brush, there is no pair of protruding end ridges 22 on the ferrule, or any corresponding internal side grooves 26 formed in the interior of the ends of the cavity of the paint brush handle 10. Since the panel 12 pivots on pins 14 close to the bristle end of the brush 10, the end faces cannot be pivoted away to receive the bristle pack. Thus the ferrule 18 must be of the design shown in FIGS. 8 and 9 with no end ridges which will interfere with entry of the bristle pack and ferrule 18 into and out of the cavity. The internal ferrule 18 still has, however, the horizontal ridges 20 which enable the panel 12 and the opposite brush side to bear against the internal ferrule 18 and grip it securely. The panel 12 has a resilient release clip 15 which assists in holding panel 12 in a closed position by catching on the edge 17 of the paint brush body 10. The ends of the body of the holder, adjacent the cavity opening, also have a pair of end slits 21 which can spread and assist insertion of the ferrule 18 into the cavity.

FIG. 12 illustrates an end section view of an embodiment of removable bristle pack and internal ferrule in position in the interior of the body of a paint brush handle having a single clamping panel 4. As seen in FIG. 12, the bristle pack 8 with the internal ferrule 18 at the top portion thereof is held securely in place by single clamping panel 4 which is in a closed position abutting on horizontal ridge 20 of the internal ferrule 18. The pair of complementary glue cavities 24, which contain glue and thereby cement the internal ferrule 18 to either side of the top portion of the bristle pack 8, are clearly visible in FIG. 12. FIG. 12 also illustrates a standard bristle separator 28, which is typically present in the top portion of the interior of the bristle pack 8. The purpose of the bristle separator 28 is to prevent the opposite free ends of the bristles 8 from spreading and thereby detracting from the usefulness of the paint brush. The free end of panel 4 also clamps against bristles 8 and holds the group of bristles together. FIG. 12 also illustrates gap 32 which serves to hold paint and thereby enables the brush to be used longer, before having to dip the brush in the paint pot for a fresh loading.

FIG. 13 illustrates an end section view of the removable bristle pack, with single clamping panel and internal ferrule, being removed from the interior of the paint brush body handle, after the clamping panel 4 has been pivoted away from a clamping position. As seen in FIG. 13, the clamping panel 4 by being pivoted away from the closed position, releases the bristle pack 8 and the internal ferrule 18 so they can be withdrawn. When the clamping panel 4 is in the open position, the bristle pack 8 and the internal ferrule 18 can be either readily removed from or re-inserted into the interior of the paint brush handle and body 2. The painted and coated bristle packs can be removed for cleaning and reused, or the old bristle pack can be replaced with a new bristle pack. While not visible in FIGS. 12 and 13, the end panels 30 (see FIG. 10) also pivot away to release the bristle pack 8.

Figure 14:
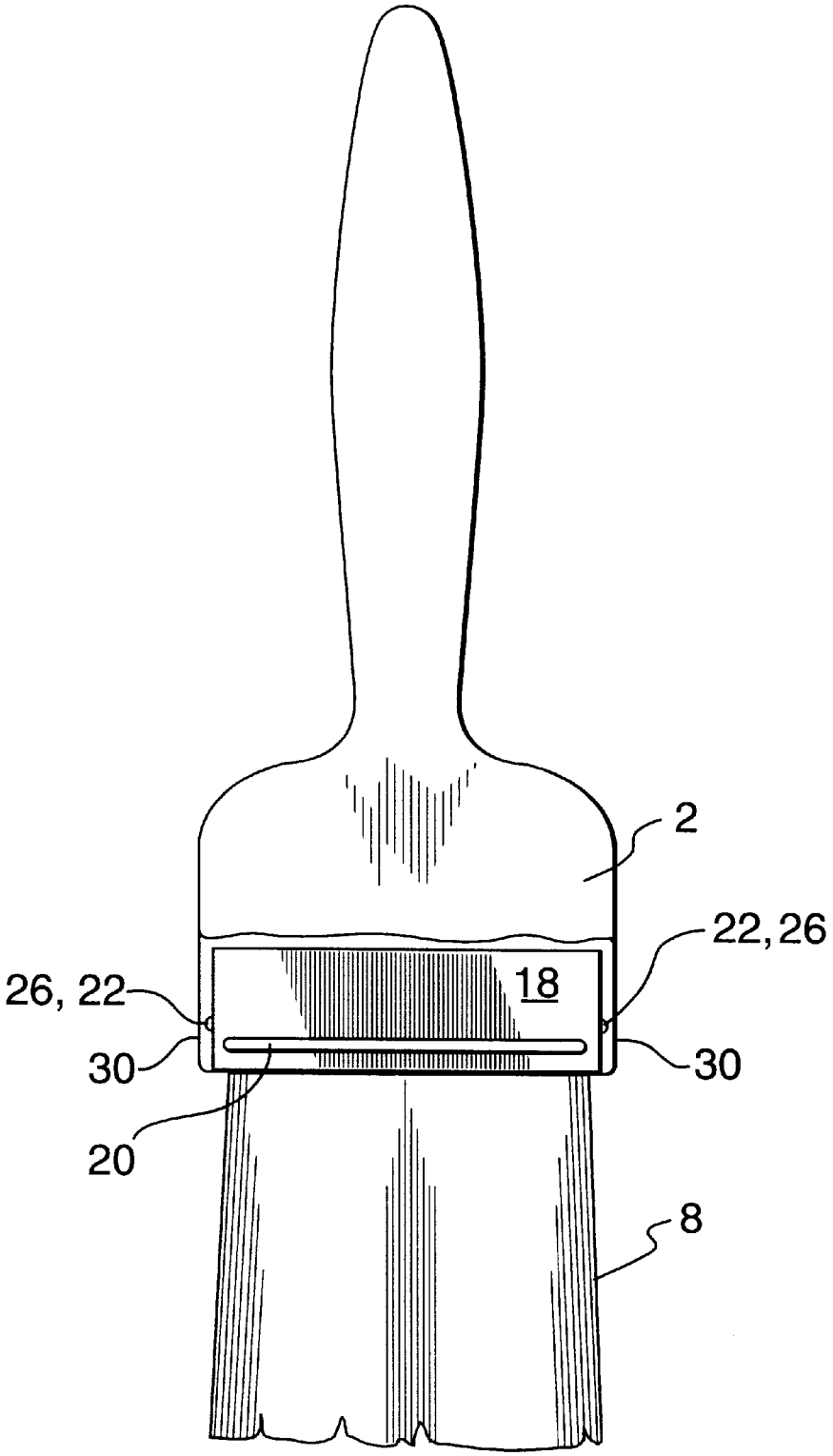
FIG. 14 illustrates a front elevation view of a paint brush handle, with replaceable bristle pack and internal ferrule as illustrated in FIGS. 3, 4 and 5 in position in the interior of the paint brush handle, the single clamping panel having been removed to expose the internal ferrule. The internal ferrule has both horizontal front and rear face ridges and opposing end ridges.

FIG. 14 illustrates a front elevation view of a paint brush handle, similar to the one shown in FIGS. 12 and 13, with replaceable bristle pack and internal ferrule as illustrated in FIGS. 3, 4 and 5, in position in the interior cavity of the paint brush handle, the clamping panel having been removed to expose the internal ferrule. As seen in FIG. 14, with the clamping panel 4 removed, the internal ferrule 18 at the top region of the bristle pack 8 fits within the interior cavity of the paint brush handle and body 2. The horizontal elongated ridge 20 extends across the bottom region of the internal ferrule 18. The complementary pair of protruding end ridges 22 extend into and fit within a matching pair of internal grooves 26 formed at the top internal ends of the two pivotal end panels 30 of the paint brush handle and body 2. The length of the internal ferrule 18 should be sufficiently long that at its lower end, it hides the glue line on the bristles 8. The uneven glue line can be unsightly, whereas the lower end of the ferrule 18 is neat and clean.

The paint brush handle and body 2 are typically formed of extruded plastic and accordingly the two end pieces 30 have a slight amount of flexibility. This enables the pair of protruding end ridges 22 of the ferrule 18 to snap into and be held in place in the complementary pair of internal grooves 26 formed in the two end panels 30 of the paint brush handle 2. In this way, the bristle pack is securely fixed in the cavity of the paint brush when the clamping panel 4 is closed. The internal ferrule 18 is formed of relatively rigid polymer material so that end ridges 22 hold securely in the cavity.

The embodiments of internal ferrules and paint brushes illustrated and discussed in this application can be produced on automated assembly lines. It will be understood that various indentations and ridges may be formed in the products in order to facilitate handling by the automated assembly line.

Example

The paint brush must be formed of an appropriate polymer so that it comprises a blend of stiffness (a flexible brush would be too floppy when used) and resilience so that the brush, and particularly the pivot panels, stand up to abuse, such as occurs when the brush is inadvertently dropped. Tests with various polymers have been conducted and the following table and calculations, demonstrate the manner in which an appropriate blend of polymers for the paint brush was reached. Through trial and error, it was concluded that a blend of 25% #3434 ACCTUF polypropylene and 75% #9346 provides an acceptable paint brush.

NEW RESIN BLEND
ORIGINAL RESIN - #9346 (RED)
TRIAL RESIN (handle only) ACCTUF #3434 (YELLOW)

| SPECS. | IZOD. | FLEX MOD. | HEAT |
|---|---|---|---|
| #9346 | .4 | 320 | 260° |
| ACCTUF #3434 | 3.8 | 200 | 225° |
| 20% #3434 - Blend 80% #9346 Approx. > | 1.08 | 296 | 253° |
| 25% #3434 - Blend 75% #9346 Approx. > | 1.25 | 290 | 251° |

-continued

| NEW RESIN BLEND<br>ORIGINAL RESIN - #9346 (RED)<br>TRIAL RESIN (handle only) ACCTUF #3434 (YELLOW) | | |
|---|---|---|
| CALCULATIONS | | |
| IZOD. | FLEX MOD. | HEAT |
| 3.8 | 320 | 260 |
| 0.4 | 200 | 225 |
| = 3.4 Difference | = 120 Difference | = 35 Difference |
| 20% of 3.4 | 20% of 120 | 20% of 35 |
| = .68 | = −24 | = −7.00 |
| +.40 | 320 | 260.00 |
| = 1.08 | = 296 | = 253.00 |
| 25% of 3.4 | 25% of 120 | 25% of 35 |
| = .85 | = −30 | = −8.75 |
| +.40 | 320 | 260.00 |
| = 1.25 | = 290 | = 251.00 |

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An internal ferrule for use with a paint brush handle and a removable bristle pack comprising:

(a) a hollow girdle for encircling a first end of a bundle of parallel bristles, the girdle having interior and exterior faces;

(b) a concave glue cavity formed in an interior face of the hollow girdle; and (c) a protrusion formed on an exterior face of the girdle for engaging with a releasable securing member associated with the body of a paint brush handle.

2. An internal ferrule as claimed in claim 1 wherein the ferrule has a hollow rectangular shape.

3. An internal ferrule as claimed in claim 2 wherein the rectangular shaped ferrule has a pair of protrusions formed in opposite exterior face ends of the ferrule.

4. An internal ferrule as claimed in claim 3 wherein a complementary pair of protrusions are formed on opposite exterior side faces of the rectangular ferrule.

5. An internal ferrule as claimed in claim 2 wherein two opposing exterior faces of the internal ferrule have complementary quadrangle shapes.

6. A paint brush comprising:

(a) a paint brush body having a first end and a second end, and a first side and a second side, and a handle connected to the first end of the body, the body having formed in the second end thereof opposite the handle a cavity for receiving one end of a group of bristles;

(b) a group of bristles held together and having a first end which is received in the cavity, and a second free end which protrudes from the cavity;

(c) a hollow girdle for encircling the first end of the group of bristles;

(d) a concave glue cavity formed in an interior face of the hollow girdle;

(e) a protrusion formed on the exterior of the hollow girdle for removably engaging with a releasable member associated with the paint brush body; and (f) at least one hinged releasable member secured to the first side of the paint brush body, and projecting over the cavity, the hinged releasable member abutting and securing the girdle when moved to a first closed position, and being spaced from and releasing the girdle when moved to a second open position.

7. A paint brush as claimed in claim 6 including a securing member for securing the hinged releasable member in the first closed position and releasing the hinged releasable member when in a second open position.

8. A paint brush as claimed in claim 6 wherein the girdle is an internal ferrule that has a hollow rectangular shape.

9. A paint brush as claimed in claim 8 wherein the hollow rectangular shaped ferrule has a pair of protrusions formed in opposite exterior face ends of the ferrule.

10. A paint brush as claimed in claim 9 wherein the cavity includes two grooves for receiving the pair of protrusions formed on the exterior faces of the internal ferrule.

11. An internal ferrule as claimed in claim 9 wherein a complementary pair of protrusions are formed on opposite exterior side faces of the rectangular ferrule.

12. An internal ferrule as claimed in claim 8 wherein two opposing exterior side faces of the internal ferrule have complementary quadrangle shapes.

13. A paint brush as claimed in claim 6 wherein the hinged releasable member pivots in a manner whereby the free end of the hinged releasable member, when in a closed position, abuts and holds the external face of the girdle on the bristle pack.

14. A paint brush as claimed in claim 6 wherein the hinged releasable member pivots in a manner whereby the free end of the releasable member faces the handle of the paint brush and the pivot axis for the releasable member is located laterally across the body of the paint brush at the edge of the cavity.

* * * * *